US011313543B2

(12) United States Patent
Donnelly et al.

(10) Patent No.: US 11,313,543 B2
(45) Date of Patent: Apr. 26, 2022

(54) SCREW RAMP JOINER BRACKET AND SYSTEM FOR ADJOINING LIGHT FIXTURE SECTIONS

(71) Applicant: Focal Point, LLC, Chicago, IL (US)

(72) Inventors: Megan A. Donnelly, Darien, IL (US); Paul O. Ocampo, Chicago, IL (US); Alec J. Schultz, Chicago, IL (US); Sam Riehl, Chicago, IL (US)

(73) Assignee: Focal Point, LLC, Chicago, IL (US)

( * ) Notice: Subject to any disclaimer, the term of this patent is extended or adjusted under 35 U.S.C. 154(b) by 0 days.

(21) Appl. No.: 16/688,962

(22) Filed: Nov. 19, 2019

(65) Prior Publication Data

US 2021/0148531 A1 May 20, 2021

(51) Int. Cl.

| | |
|---|---|
| ***F21V 21/005*** | (2006.01) |
| ***F21S 8/02*** | (2006.01) |
| ***F21V 21/112*** | (2006.01) |
| *F21S 8/04* | (2006.01) |
| *F21V 15/015* | (2006.01) |

(52) U.S. Cl.

CPC ..... *F21V 21/005* (2013.01); *F21S 8/026* (2013.01); *F21V 21/112* (2013.01); *F21S 8/043* (2013.01); *F21V 15/015* (2013.01)

(58) Field of Classification Search

CPC ..... F21V 23/06; F21V 21/005; F21V 21/025; F21V 21/112; F21S 8/043; F21S 8/026

See application file for complete search history.

(56) References Cited

U.S. PATENT DOCUMENTS 2,291,490 A * 7/1942 Naysmith ..... F21V 21/005 362/221
2,383,007 A * 8/1945 Maurette ..... F21V 21/005 362/457
2,988,633 A * 6/1961 Rosenfield ..... F21V 23/06 362/219
2,990,470 A * 6/1961 Bodian ..... F21V 7/0016 362/219

(Continued)

FOREIGN PATENT DOCUMENTS

DE 20 2015 100 867 U1 4/2015

OTHER PUBLICATIONS

Pinnacle Architectural Lighting, EDGE EX3D, 3" Suspended Direct Linear, Designed and Fabricated in Denver, CO • USA | pinnacle-ltg.com | EX3D_LED_SPEC_JULY 2019, 7 pgs.

*Primary Examiner* — Muhammad Ijaz
*Assistant Examiner* — Taylor L Morris
(74) *Attorney, Agent, or Firm* — Greenberg Traurig, LLP

(57) ABSTRACT

An example joiner system for joining a first section and a second section of a fixture includes a joiner bracket that has formed therein a depressed ramp region. A joiner fastener, such as a screw, may engage against the angled walls of the joiner bracket ramp, to translate the vertical movement of the screw into a horizontal, longitudinal movement of the joiner bracket. The joiner bracket may be rigidly coupled to one section of a light fixture assembly, such that engaging the screw ramp with a fastener that extends through another section of the light fixture causes the two fixture sections to move toward each other. As vertical movement of a fastener produces horizontal movement of the joiner bracket, the joiner fastener or set screw may extend outside of the light fixture assembly, so as to be readily accessible by a technician.

18 Claims, 11 Drawing Sheets

(56) References Cited

U.S. PATENT DOCUMENTS 3,011,047 A * 11/1961 Spaulding ..... F21S 8/08 362/219
3,718,816 A 2/1973 Seelbach et al.
4,219,868 A * 8/1980 Bowman ..... F21S 8/06 362/147
4,717,993 A * 1/1988 Bernhart ..... F21V 21/005 362/219
4,726,781 A * 2/1988 Bernhart ..... F21V 21/005 362/219
4,976,633 A * 12/1990 Beghelli ..... F21V 21/02 362/404
5,226,724 A * 7/1993 Kanarek ..... F21S 2/00 362/151
5,624,202 A 4/1997 Grierson
5,658,066 A 8/1997 Hirsch
6,517,222 B1 * 2/2003 Orlov ..... F21S 8/06 248/325
6,568,830 B2 * 5/2003 Yaphe ..... F21S 8/06 362/147
7,380,957 B2 6/2008 Lanczy
7,396,149 B2 * 7/2008 Dicken ..... E04B 9/32 248/343
7,758,358 B1 * 7/2010 Mier-Langner ..... H01R 35/04 439/115
8,454,192 B2 * 6/2013 Rouse ..... F21S 4/20 362/217.12
9,261,263 B2 * 2/2016 Pearson ..... F21V 21/112
9,541,266 B2 1/2017 Bolscher
9,897,294 B2 * 2/2018 Pearson ..... F21V 21/008
10,066,812 B1 * 9/2018 Esteves ..... F21V 21/005
10,082,262 B2 * 9/2018 Butler ..... F21V 3/00
10,754,076 B1 * 8/2020 Garner ..... G02B 6/001
10,801,709 B1 * 10/2020 Schultz ..... F21V 21/36
2005/0041419 A1 * 2/2005 Kazi ..... F21V 15/01 362/219
2005/0047129 A1 * 3/2005 Eppler ..... F21V 15/01 362/217.01
2005/0152132 A1 * 7/2005 Bernhart ..... H01R 25/14 362/147
2006/0138921 A1 * 6/2006 Klein ..... F21S 2/005 313/10
2006/0158877 A1 * 7/2006 Lanczy ..... F21V 21/005 362/217.17
2009/0034243 A1 * 2/2009 Yaphe ..... F21S 8/06 362/147
2011/0080746 A1 4/2011 Patti
2013/0294061 A1 * 11/2013 Sorensen ..... F21S 8/06 362/223
2014/0307438 A1 * 10/2014 Pearson ..... F21V 29/70 362/249.03
2015/0226384 A1 8/2015 Park
2015/0292719 A1 * 10/2015 Park ..... F21S 8/026 362/221
2016/0369985 A1 * 12/2016 Fortin ..... F21V 21/005
2017/0107894 A1 * 4/2017 Ocampo ..... F02B 19/04
2017/0261190 A1 * 9/2017 Hierzer ..... F21S 8/063
2018/0017236 A1 * 1/2018 Clark ..... F21V 23/06
2018/0031217 A1 2/2018 Tuchler
2018/0112856 A1 * 4/2018 Yaphe ..... F21V 21/005
2018/0172257 A1 * 6/2018 Hierzer ..... F21S 4/28
2018/0172898 A1 * 6/2018 Blessitt ..... F21S 8/026
2018/0180265 A1 * 6/2018 SanFacon ..... F21S 2/005
2018/0252395 A1 * 9/2018 Baker ..... F21V 17/107
2019/0041041 A1 2/2019 DeBruin et al.
2019/0078762 A1 * 3/2019 Ju ..... F21S 8/06
2019/0088241 A1 * 3/2019 Czech ..... F21V 33/00
2020/0132262 A1 * 4/2020 Sonneman ..... F21S 8/06

* cited by examiner

SCREW RAMP JOINER BRACKET AND SYSTEM FOR ADJOINING LIGHT FIXTURE SECTIONS

FIELD OF THE INVENTION

The present invention generally relates to joiner brackets, and more specifically to a joiner bracket system that is used to join together sections of a suspendable light fixture, using a screw or other fastener driven against a ramp of a joiner bracket.

BACKGROUND OF THE INVENTION

Traditionally, many lighting systems have been sold as ready-made or pre-configured systems. In some cases, lighting systems are delivered as parts to be assembled on a job site. In such cases, a user or technician may be tasked with following a series of steps to assemble the light fixture, and to subsequently hang, mount, or otherwise place the light fixture into a desired position within a room or space. For large lighting systems—such as lighting systems in large rooms and/or in commercial settings—the assembly and installation process presents many challenges. Joining two or more independent fixture sections together to create a simple, larger fixture with a seamless connection can be difficult. If the lighting system is first assembled on the ground, then a user or technician must devise a way to lift and place a large and heavy lighting system into position. For wall-mounted, ceiling-mounted, or pendant lighting systems, assembling a large and heavy light fixture on the ground may simply not be feasible. Moreover, construction sites may not have a sufficient amount of floor space to enable a user or technician to carry out an initial ground-based assembly in the first place, or may present a potential for scratches, dirt or dents to exterior fixture components.

In other cases, a lighting system of single or multiple components may be configured for assembly while suspended or mounted. For example, multiple sections of a lighting system may be independently suspended from a ceiling, and subsequently brought together to form a substantially continuous light fixture. With each section being of a manageable size and weight, so as to be handled by one or only a few technicians, such an installation process may be carried out without the need for machinery or other assistance to lift a substantially heavy and cumbersome pre-assembled light fixture into position.

While suspended, the piece-part assembly of a light fixture can be effectively performed without the need for substantial equipment or lift assistance, there remains a few drawbacks. Further, the process of joining adjacent sections of a light fixture often involves a technician on a ladder or scaffold articulating the opposing sections, and securing the two together—typically using one or more fasteners, together sometimes within "live" electrical leads. This process can be risky to a technician, as it may be difficult to hold together adjacent sections while simultaneously locating and engaging the joining mechanism. It is therefore an object of the present invention to provide a joining system that is safe, accessible and easier to operate by a single technician.

In addition, joining systems for light fixture assemblies are often difficult to access and operate. Commonly, joining systems are preferably disposed within the housing of light fixture sections, such that they can be obscured from view and do not adversely affect the aesthetic qualities of the light fixture. While these arrangements are desirable to maintain the light fixture's aesthetic qualities and to obscure the joining system from view, they can complicate or otherwise make difficult the installation process for the light fixture. Often, an installation process can require the use of specialized or uncommon tools to reach the fasteners and operate the joining system.

Some existing fixture joining systems have been difficult to access, and often require the removal (and/or subsequent re-installation of) elements of a light fixture assembly, such as lenses, reflectors, or other parts. As a result, light fixture assemblies that use such joining systems may require a technician to perform some disassembly and re-assembly of pre-assembled fixture sections, or may prevent a manufacturer from pre-assembling sections of a light fixture that would otherwise reduce the time involved to install the light fixture. In either case, the installation of a light fixture assembly may take more time and/or be more complicated than is desired. It is therefore another object of the present invention to provide a joining system that can be partially pre-installed, and which reduces the number of installation steps to, in turn, substantially reduce the time and effort involved in assembling and installing a light fixture.

Furthermore, many existing joining systems for multiple-piece light fixtures involve the securing of connections in and through one or more components of the joining system. Often, these connection points are located along the components that reside within the light fixture, requiring the partial disassembly of a light fixture assembly and/or requiring a technician to secure fasteners in tight and dark spaces (in the absence of an existing lighted fixture) within the light fixture assembly. It is therefore yet another object of the present invention to provide a joining system that can be operated to bring together, in a facilitated manner, two or more fixture sections from the outside of the light fixture assembly.

These and other objectives and advantages of the present invention will become apparent from the following detailed written description, drawing figures, and claims.

SUMMARY OF THE INVENTION

To accomplish the aforementioned objectives, embodiments of the present invention provide for a joining system that includes a joiner bracket having formed therein a depressed ramp region. A joiner fastener, such as a screw, may be driven against the angled walls of the joiner bracket ramp, which translates vertical movement (e.g., downward) of the screw into horizontal or longitudinal movement of the joiner bracket. The conversion of vertical to longitudinal movement by way of a ramp may be leveraged in order to provide a joining system for joining together a pair of fixture sections of a light fixture assembly. The joiner bracket may be rigidly affixed to one fixture section, with the portion of the joiner bracket having the ramp region extending beyond an end of that fixture section. The extending portion of the joiner bracket may be positioned within an adjacent fixture section, with the ramp region being positioned below an aperture of the adjacent fixture section. The joiner fastener may be driven through the aperture of the adjacent fixture section and against the joiner bracket ramp to, in turn, pull the fixture sections together, as fasteners are being engaged. The fastener that drives against the ramp of the joiner bracket may be advantageously accessible from the outside of the light fixture assembly, making the installation process easier, simpler and safer, as compared to traditional joining systems.

In some cases, the screw ramp and joiner fastener may produce a force that is unevenly applied across the height of the fixture sections. For example, the screw ramp joiner may pull together the upper ends of a pair of fixture sections, resulting in a substantial gap remaining between the lower ends of the pair of fixture sections. To address this problem, some embodiments of the present invention may include a joiner bracket having a top section with two portions—with one portion being angled or sloped at a slight angle relative to the other portion. The sloped portion of the joiner bracket may include a finishing bore or boss. The joining system may further include a finishing screw or other fastener that can be driven through a fixture section and into the finishing bore of the joiner bracket. As the finishing screw is driven through the sloped portion of the joiner bracket, that sloped portion of the joiner bracket may be pulled upwards toward the fixture section. This upward force, together with the rigid coupling of the joiner bracket to the adjacent fixture section, produces a torque that pulls the lower ends of the pair of fixture sections toward each other for closing the gap between the pair of fixture sections.

According to a first aspect of the present invention, there is provided a lighting fixture system that includes a first fixture section having a proximal end and a distal end opposite the proximal end, a first sidewall and a second sidewall each extending between the proximal and distal ends of the first fixture section, and a top portion extending between the first and second sidewalls of the first fixture section. The top portion of the first fixture section includes a boss extending therethrough. The proximal and distal ends of the first fixture section define a longitudinal direction. The lighting fixture system also includes a second fixture section having a proximal end and a distal end opposite the proximal end, a first sidewall and a second sidewall each extending between the proximal and distal ends of the second fixture section, and a top portion extending between the first and second sidewalls of the second fixture section. The proximal end of the second fixture section is adapted for positioning adjacent to the distal end of the first fixture section. The lighting fixture system further includes a joiner bracket adapted for positioning within at least a portion of the first fixture section and at least a portion of the second fixture section. The joiner bracket may be rigidly coupled to the second fixture section and have a portion extending beyond the proximal end of the second fixture section toward the distal end of the first fixture section. The portion of the joiner bracket extending beyond the proximal end of the second fixture section includes a ramp that is angled relative to the top portion of the first fixture section. Additionally, the lighting fixture system includes a fastener configured to extend through the boss of the first fixture section and engage against the ramp of the joiner bracket to produce a force in the longitudinal direction toward the proximal end of the first fixture section. When the joiner bracket is rigidly coupled to the second fixture section, engaging the fastener with the ramp of the joiner bracket pulls the second fixture section toward the first fixture section.

In some embodiments according to the first aspect, the boss of the first fixture section is a threaded boss, and the fastener is a threaded fastener.

In some embodiments according to the first aspect, the fastener is a first fastener, and the portion of the joiner bracket contained within the second fixture section includes one or more bores. The lighting fixture system may also include one or more second fasteners extend through the one or more respective bores and into the second fixture section to rigidly couple the fastener to the second fixture section.

In some embodiments according to the first aspect, the first fixture section further includes a first rail positioned along the first sidewall of the first fixture section, and the second fixture section further includes a first rail positioned along the first sidewall of the second fixture section. In these embodiments, the joiner bracket further includes a first sidewall and a second sidewall, with the first sidewall of the joiner bracket having formed therein an offset having a shape that is complementary to the first rail of the first fixture section and the first rail of the second fixture section.

In some embodiments according to the first aspect, the fastener is a first fastener, and the joiner bracket also includes a finishing aperture, in which the first fixture section further comprises a finishing bore. In these embodiments, the lighting fixture system further includes a finishing fastener adapted to extend through the finishing bore and the finishing aperture of the joiner bracket.

In some embodiments according to the first aspect, the lighting fixture system also includes an outer bracket configured for positioning along at least part of the top portion of the first fixture section and at least part of the top portion of the second fixture section.

In some embodiments according to the first aspect, the first fixture section also includes at least one lipped channel extending longitudinally along the top portion of the first fixture section. In these embodiments, the outer bracket is adapted to slideably engage with the at least one lipped channel of the first fixture section. In some instances, the lighting fixture system may further include a cable gripper coupled to the outer bracket, with the cable gripper being adapted to maintain a suspension cable therethrough for suspending the light fixture system from a ceiling In some embodiments according to the first aspect, the first fixture section further includes a first rail positioned along the inner walls of the top portion of the first fixture section. In these embodiments, the joiner bracket further includes an elongated male projection adapted to slideably engage with the first rail of the first fixture section, to facilitate alignment of the joiner bracket with respect to the first fixture section.

In some embodiments according to the first aspect, the ramp of the joiner bracket comprises a first angled wall and a second angled wall that converge to form an oblique corner.

In some embodiments according to the first aspect, the portion of the joiner bracket contained within the proximal end of the second fixture section has a first top surface, and the portion of the joiner bracket that extends beyond the proximal end of the second fixture section has a second top surface. The first top surface may be angled relative to the second top surface.

According to a second aspect of the present invention, there is provided a joiner system for joining the distal end of a first fixture section to the proximal end of a second fixture section, the first fixture section including an aperture formed therethrough. The joiner system includes a joiner bracket adapted for positioning within at least a portion of the first fixture section and at least a portion of the second fixture section. The joiner bracket may be rigidly coupled to the second fixture section and having a portion extending beyond the proximal end of the second fixture section toward the distal end of the first fixture section. The portion of the joiner bracket that extends beyond the proximal end of the second fixture section includes a ramp that is angled relative to the top portion of the first fixture section. The distal end of the first fixture section and the proximal end of the second fixture section define a longitudinal direction. The joiner system also includes a fastener configured to extend through the aperture of the first fixture section and engage against the ramp of the joiner bracket to produce a force in the longitudinal direction toward the proximal end of the first fixture section. When the joiner bracket is rigidly coupled to the second fixture section, engaging the fastener with the ramp of the joiner bracket pulls the second fixture section toward the first fixture section.

The foregoing summary is illustrative only and is not intended to be in any way limiting. In addition to the illustrative aspects, embodiments, and features described above, further aspects, embodiments and features will become apparent by reference to the drawing figures, the following detailed description, and the claims.

BRIEF DESCRIPTION OF THE DRAWINGS

For a better understanding of the invention, and to show how the same may be implemented, there will now be described, by way of example, specific embodiments, methods and processes according to the present invention with reference to the accompanying drawings in which.

DETAILED DESCRIPTION OF THE EMBODIMENTS

Figure 1:
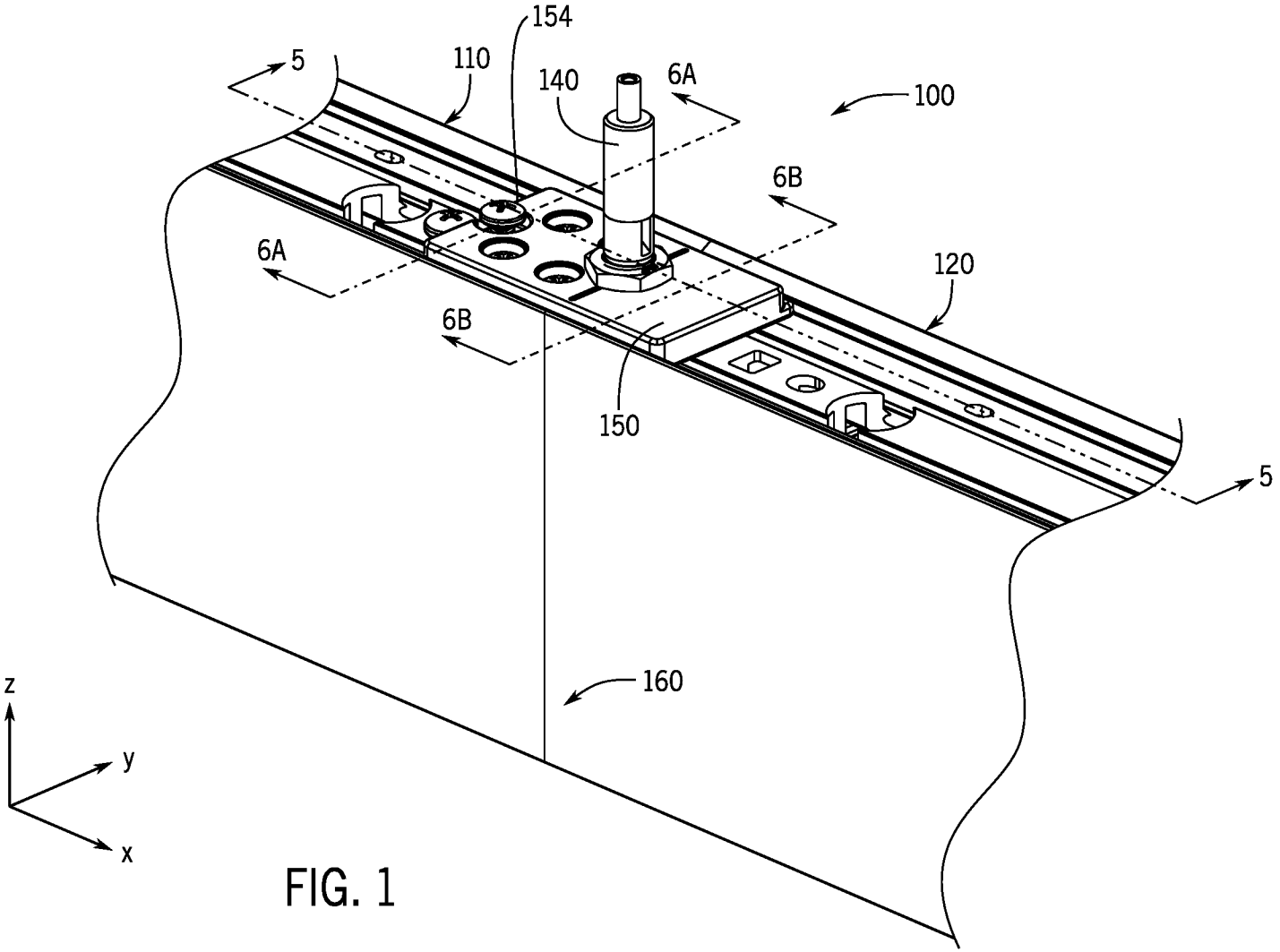
FIG. 1 is a perspective view of a light fixture assembly in an assembled state, in which the interior portions of the screw ramp joiner are not shown.

There will now be described by way of example, several specific modes of the invention as contemplated by the inventor. In the following description, numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description of the invention.

Embodiments of the present invention provide for a joiner system for adjoining adjacent light fixture sections. As described above, joining together sections of a light fixture can be challenging, dangerous, and sometimes require the use of specialized tools to operate a joining system—particularly in situations where sections of a light fixture assembly are suspended separately, and joined together while suspended to form a complete light fixture assembly. Some joining systems may be relatively inexpensive and simple to manufacture, but such systems often require a technician to perform difficult maneuvers. For example, joiners are often positioned within the inner walls of a light fixture to obscure them from view after installation, which makes them difficult to access and operate safely, and often leads to frustration, misalignment and/or possible injury. Other more robust joining systems have attempted to improve upon the installation process for the technician, but the increased mechanical complexity of such systems typically renders such systems significantly more expensive and less reliable than simpler alternatives. The joiner systems shown and described herein address these problems using a ramp and fastener system that translates downward movement of a fastener into horizontal movement that pulls together adjacent fixture sections, enabling a set screw construction that is easily accessible from outside of the light fixture assembly.

An example joiner includes a depressed "screw ramp" region formed along its top section, which includes an angled wall or walls that serve to translate downward movement of a screw or other fastener into longitudinal forces that pull together sections of a light fixture assembly. By rigidly coupling the joiner bracket to one section of a light fixture, the "pulling" forces applied to that joiner bracket by way of a joiner fastener through another section of the light fixture causes the two fixture sections to be joined together. Other brackets, fasteners, and/or other elements may be provided to reinforce the joint and improve robustness and longevity of the joining system.

The present application addresses the realization that a joiner may include an angled "ramp" section that can convert a force in one direction (e.g., a downward vertical direction) into a force in an orthogonal horizontal direction (e.g., a longitudinal direction). As many joining systems for light fixture assemblies attempt to bring together two elongated horizontally displaced light fixture sections, this realization enables the construction of a screw ramp joiner system in which the screw or fastener that effectuates the joining of the two fixture sections can extend above or below the light fixture, and therefore be relatively easy to access and operate without using specialized tools that can reach into the inner cavity of the light fixture assembly. The use of a ramp and fastener over more complex mechanical systems (e.g., gear systems such as a rack-and-pinion gear) for converting motion from one axis to another enables joiner systems according to the present disclosure to be manufactured at a relatively low cost, while also reducing the number of components that have the potential to fail.

As described herein, upwardly illuminating light fixtures may be referred to as "indirect" (e.g., illuminating the ceiling), downwardly illuminating light fixtures may be referred to as "direct" (e.g., illuminating the floor or other surfaces beneath the light fixture), and upwardly and downwardly illuminating light fixtures may be referred to as "bidirectional."

As described herein, the term "screw" generally refers to any type of actuatable fastener, and does not necessarily refer solely to a threaded fastener. For example, bolts, pins, cams, and/or other types of fasteners may be suitable for use in a joiner system based on the principles disclosed herein. Accordingly, any element shown and/or described herein as a screw-based element, such as a screw ramp or a screw ramp joiner, is not limited to threaded fasteners and may use other suitable non-threaded fasteners. The use of the term "screw" throughout the present disclosure is provided for explanatory purposes, and should not be construed as limiting the scope of the present application in any way.

As described herein, the term "screw ramp" refers to a wall or walls formed within a joiner or bracket at a non-right angle relative to its adjacent surfaces, such that a force applied against the angled wall or walls is translated from the direction of the force to a direction that is orthogonal to the direction of the force. The screw ramp may be substantially smooth, or may have features formed in the walls to increase friction or otherwise enhance the engagement between a fastener and the wall or walls of the screw ramp. For the purposes of the present application, a "screw ramp" refers generally to a feature, surface, wall, or some combination thereof that in operation translates a force applied thereto in one direction to another direction.

The following description of FIGS. 1-9 may include position and orientation terminology related to light fixture assemblies and/or components therein. Each of the figures has included therewith a set of x-y-z axes that will be used to describe the relative position and/or orientation of components. Any particular terminology used to denote the location, orientation, and/or direction of movement of parts is used for explanatory purposes only.

FIG. 1 illustrates a perspective view of light fixture assembly 100, with screw ramp joiner 130 positioned therewithin (not shown in FIG. 1). Light fixture assembly 100 includes a pair of adjacent fixture sections 110 and 120, which are in alignment and rigidly held together by screw ramp joiner 130 (see FIGS. 2-9) and outer bracket 150. Cable gripper 130 may affix to outer bracket 150 to enable light fixture assembly 100 to be suspended from a ceiling by way of suspension cables or the like.

Fixture sections 110 and 120 may each be formed as an extruded aluminum housing, for example, and incorporate one or more rails, lips, channels, bores, threaded screw holes, and/or other features to which various elements may be affixed or with which various elements may engage. For example, rails 113, 114, 123, and 124 (see, e.g., FIGS. 3, 6A and 6B) may protrude inwardly from the inner surfaces of the sidewalls of fixture sections 110 and 120, with which corresponding portions of screw ramp joiner 130 may slideably engage. In addition, channels 111, 112, 121, and 122 (see, e.g., FIGS. 3, 6A and 6B) may extend longitudinally (in the x-direction) from the inner surfaces of the top portions of fixture sections 110 and 120, into which screws or other fasteners can engage and maintain components in rigid connection with the fixture section 110 and/or fixture section 120. Similarly, channels formed along the outer surfaces of the top portions of fixture sections 110 and 120 (in the positive z-direction) may provide anchor points for screws or other fasteners to affix outer bracket 150 to fixture section 110 and/or fixture section 120. In the example shown in FIGS. 1-6B, fixture section 110 and/or fixture section 120 may include lipped channels, such as lipped channels 115 and 116, which extend upwardly (in the positive z-direction) and overhangs a portion of the top section of the fixture section, preventing outer bracket 150 from moving vertically after being engaged with the lipped channels.

The channels formed in fixture sections 110 and 120 may also serve as anchor points for affixing light sources (e.g., light emitting diodes, or LEDs) or other elements to the outer surface of the top portions of fixture sections 110 and 120, which may direct light upwardly (in the positive z-direction) to produce an "indirect" lighting effect, and/or for affixing light sources to the inner surfaces of fixture sections 110 and 120 to direct light downwardly (in the negative z-direction) to produce a "direct" lighting effect. In some embodiments, bores, holes, and/or bosses may extend through the top surfaces of fixture section 110 and/or fixture section 120, through which a screw or other fastener may extend to engage with components within fixture section 110 and/or fixture section 120.

In this example embodiment, outer bracket 150 includes cable gripper hole 157 (see FIG. 3), through which cable gripper 140 extends. In an example implementation, cable gripper 140 includes a flanged bottom that has a larger diameter than cable gripper hole 157, such that outer bracket 150 "anchors" cable gripper 140 and enables light fixture 100 to be suspended from a ceiling or other structure.

Figure 2:
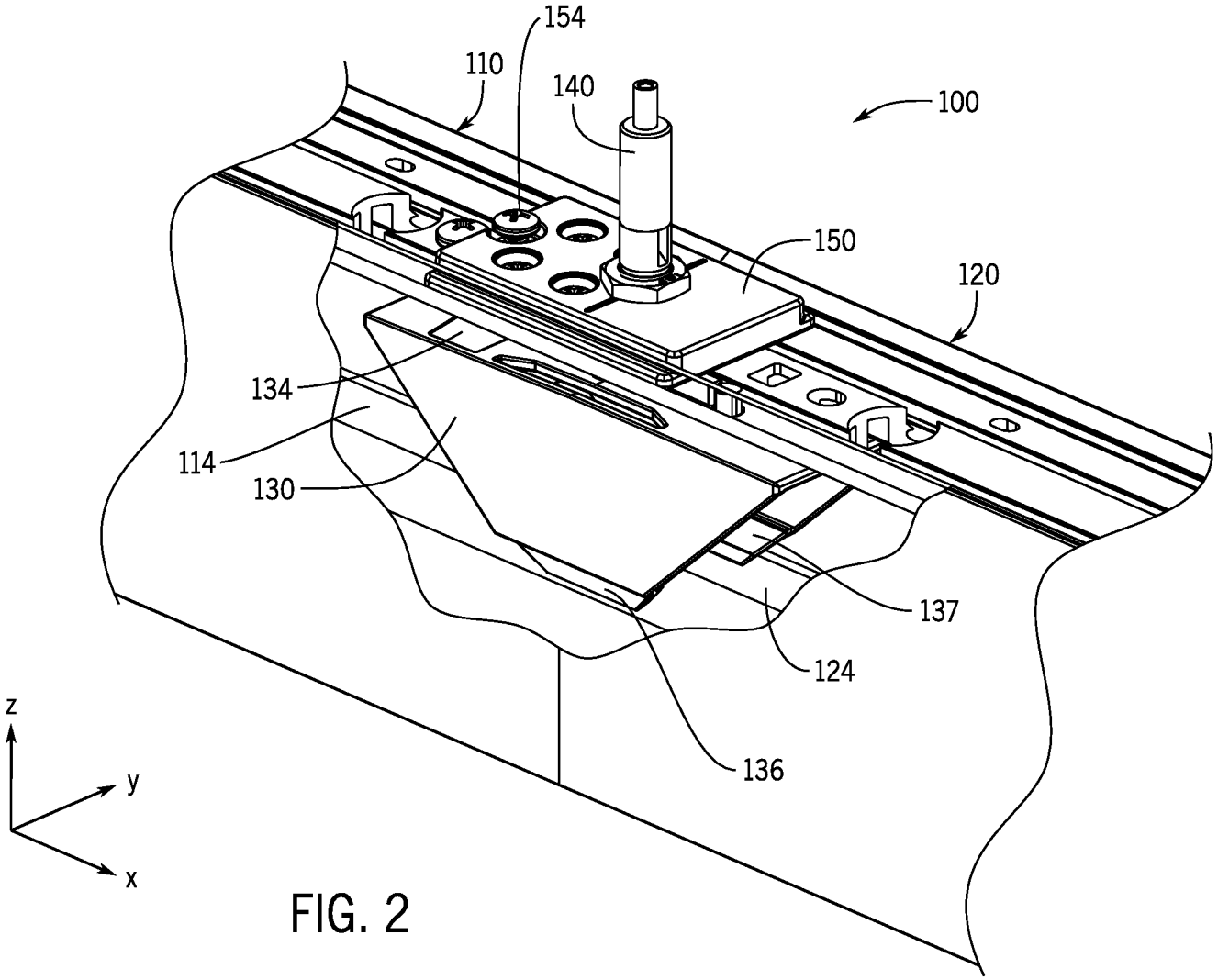
FIG. 2 is a perspective cutaway view of the light fixture assembly showing an example screw ramp joiner positioned therewithin, according to the embodiment of FIG. 1.

FIG. 2 depicts a perspective cutaway view of light fixture assembly 100, illustrating screw ramp joiner 130 positioned within the inner walls of fixture sections 110 and 120. Screw ramp joiner 130 includes a top section (in the positive z-direction) that runs along and beneath the top portions of fixture sections 110 and 120, as well as sidewalls that extend downwardly (in the negative z-direction) from the top section and are substantially parallel to the sidewalls of fixture sections 110 and 120. Offsets, shoulders, or other bends or creases may be formed in the lower ends of the sidewalls of screw ramp joiner 130, such as offsets 136 and 137 (see FIGS. 3, 7, and 8 for more detail). As shown in FIG. 2, offset 137 is positioned about rails 114, which assist in the alignment of screw ramp joiner 130 during the installation of light fixture assembly 100. In addition, offsets 136 and 137 may increase the stiffness and rigidity of screw ramp joiner 130.

Screw ramp joiner 130 also includes screw ramp 134, which is angled (in the negative z-direction and in the positive y-direction) and extends downwardly from the top section of screw ramp joiner 130. In the particular implementation shown in FIG. 2, outer bracket 150 includes aperture 155, which aligns with bore 118 in fixture section 110 (both of which are shown in more detail in FIG. 3). Joiner screw 154 is configured to extend downwardly through the aligned aperture 155 and bore 118, and engage with the angled wall of screw ramp 134. As joiner screw 154 is driven downward and against screw ramp 134, the angled wall of screw ramp 134 translates the downward force of joiner screw 154 into a horizontal force that pulls screw ramp joiner 130 toward fixture section 110 (in the negative x-direction). In this manner, a screw or other fastener accessible from outside of light fixture assembly 100 can be used to operate a joining system, significantly improving the ease of operation and safety of the technician during the installation of light fixture assembly 100.

In some implementations, one or more components of the light fixture system may include scoring, marks, or other indications to assist a technician in the alignment of the components during the installation of light fixture assembly 100. For example, as shown in FIG. 2, outer bracket 150 include scoring that extends laterally (in the y-direction) across its top surface, which are intended to approximately align with the location at which light fixture sections 110 and 120 meet. Other components may also have similar aesthetic or functional features to serve as visual or mechanical aids for the purposes of assembly and installation.

Figure 3:
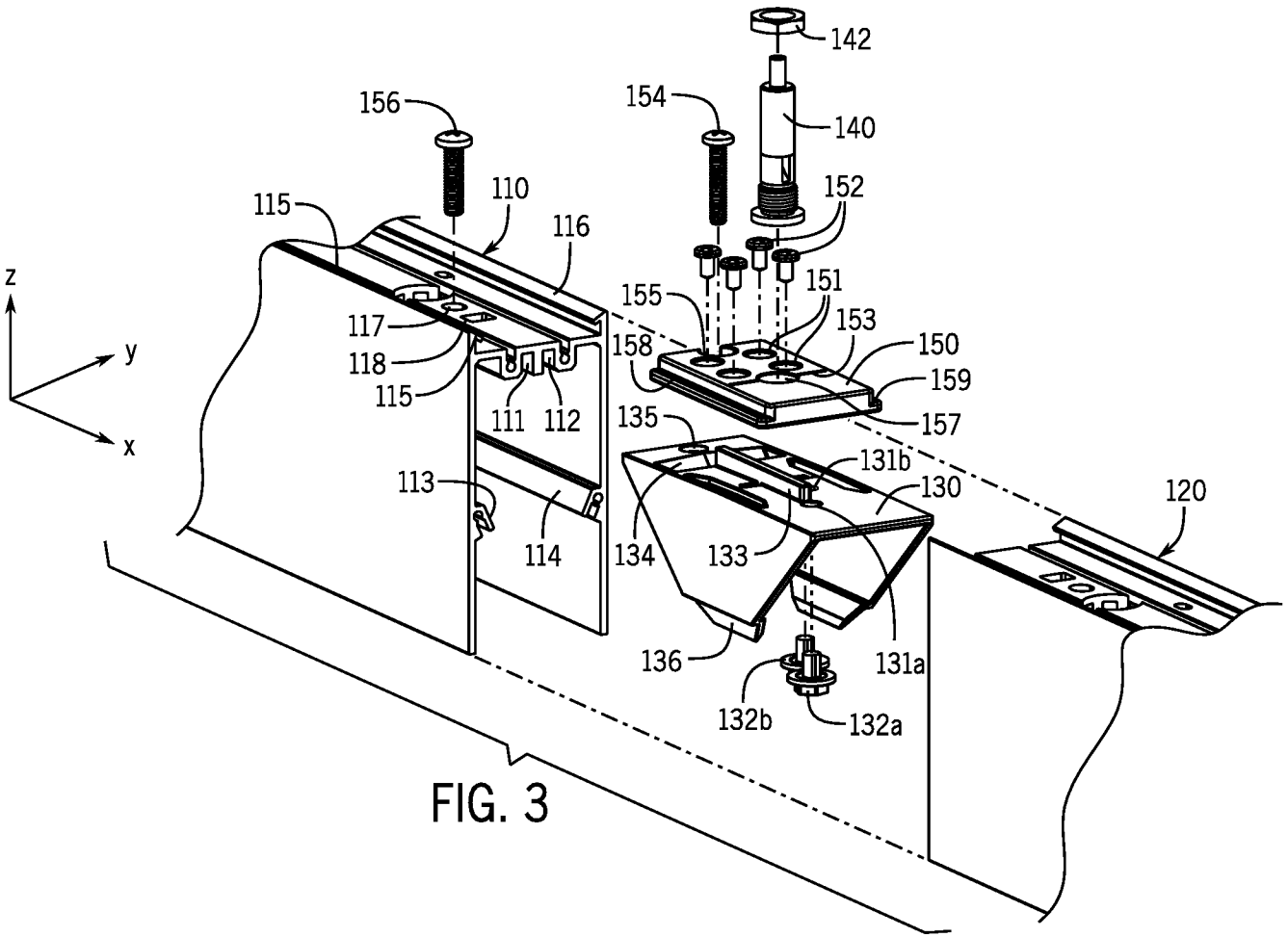
FIG. 3 is a perspective, exploded view of the light fixture assembly and screw ramp joiner system, according to the embodiment of FIG. 1.

FIG. 3 illustrates a perspective exploded view of light fixture assembly 100 with an example screw ramp joiner system. As described above, screw ramp joiner 130 is configured for positioning within the inner walls of fixture sections 110 and 120. In this example embodiment, screw ramp joiner 130 includes offset 136 that slideably engages with rail 113 of fixture section 110 and rail 123 of fixture section 120, and offset 137 that slideably engages with rail 114 of fixture section 110 and rail 124 of fixture section 120. In some implementations, additional and/or alternative features may be formed within screw ramp joiner 130 to facilitate alignment of and/or to temporarily maintain the position of screw ramp joiner 130 prior to its rigid coupling to fixture section 120. For instance, projection 133 may protrude from the top section of screw ramp joiner 130, and may slide along rails 111 and 121, or along rails 112 and 122, to further aid in the alignment of screw ramp joiner 130 during installation.

Figure 4:
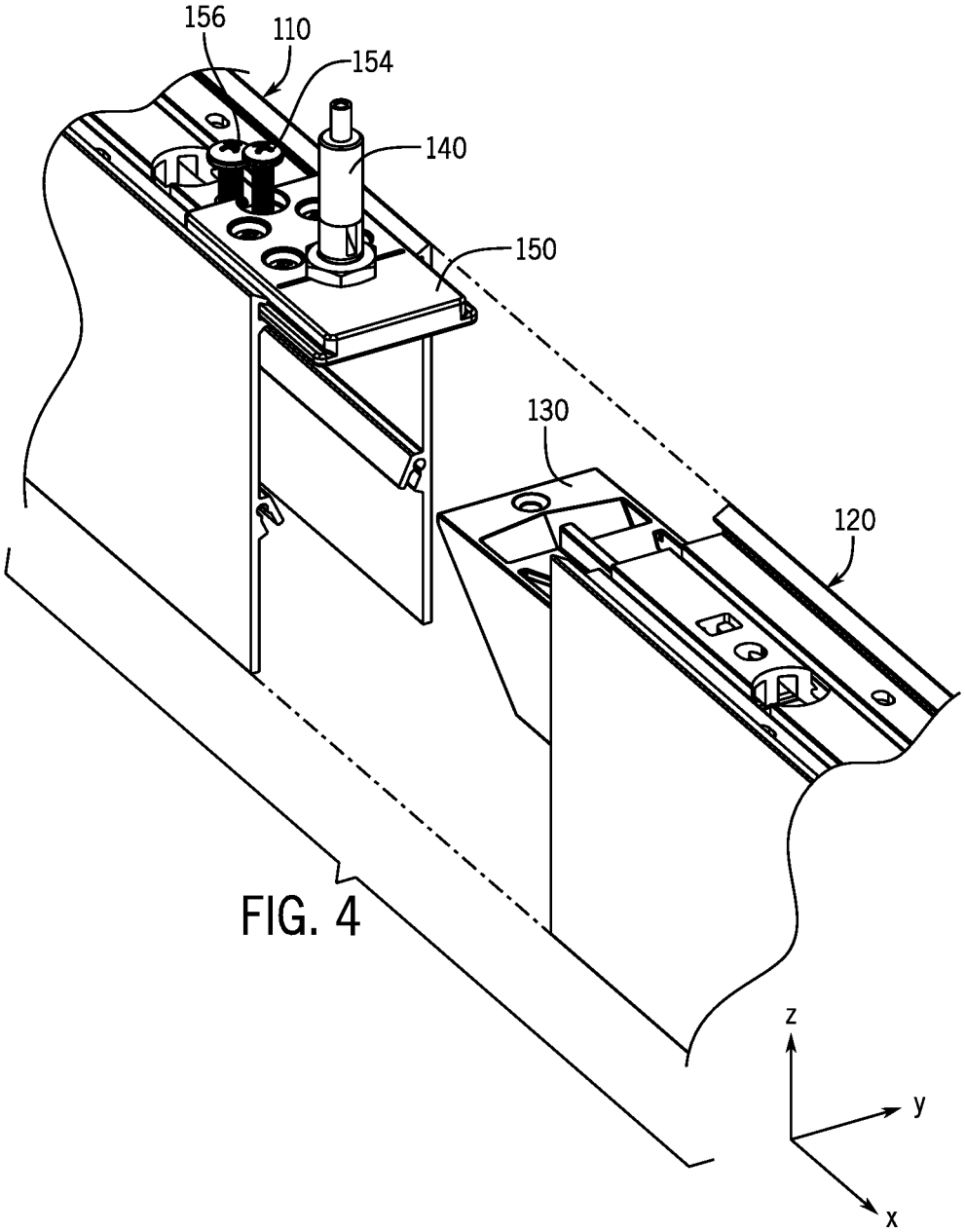
FIG. 4 is a perspective view of the light fixture assembly in a partially-assembled state, according to the embodiment of FIG. 1.

An initial installation step (or a pre-assembly step performed by a manufacturer) may involve slideably positioning screw ramp joiner 130 along rails 123 and 124 of fixture section 120, such that approximately half of screw ramp joiner 130 is contained within the inner walls of fixture section 120 (see FIG. 4). Once screw ramp joiner 130 is slid into position, fasteners 132*a* and 132*b* may be secured through holes 131*a* and 131*b*, respectively, and driven into channels 121 and 122 of fixture section 120, respectively, (see FIG. 6B) to rigidly couple screw ramp joiner 130 to fixture section 120.

Similarly, another installation or pre-assembly step may involve slideably positioning outer bracket 150 along lipped channels 115 and 116 of fixture section 110, such that a portion of outer bracket 150 extends beyond the end of fixture section 110 (see FIG. 4). Outer bracket 150 may include flanges 158 and 159 that slide under the overhanging portions of lipped channels 115 and 116, which prevents outer bracket 150 from being moved upwardly (in the positive z-direction) once it is positioned along lipped channels 115 and 116. Before outer bracket 150 is slid into position, cable gripper 140 may be extend through cable gripper hole 157 from beneath outer bracket 150. Cable gripper 140 may include a flanged bottom, and threads proximate to the flanged bottom, which enables nut 142 to be placed over and around cable gripper 140 and firmly secure cable gripper 140 to outer bracket 140. When outer bracket 150 is slid into a preferred position, fasteners 152 may be extended through holes 151 in outer bracket 150, and secured into position along channels formed in the top portion of fixture section 110 to rigidly affix outer bracket 150 to fixture section 110.

With screw ramp joiner 130 in a desired position, such as the position shown in FIG. 4, the portion of screw ramp joiner 130 extending beyond fixture section 120 may slideably engage with fixture section 110. In the example embodiment shown in FIG. 3, offsets 136 and 137 may slide along rails 113 and 114, respectively, and projection 133 may slide along channel 111. Likewise, the portion of outer bracket 150 extending beyond fixture section 110 may be slid through and under lipped channels 125 and 126 of fixture section 120, such that outer bracket 150 extends across the juncture between fixture sections 110 and 120.

In some cases, fixture sections 110 and 120 may be suspended proximate to each other from a ceiling or the like. In such cases, fixture section 110 may also "rest" on screw ramp joiner 130, such that frictional forces maintains fixture section 110 temporarily in position without the need for a technician to hold fixture sections 110 and 120 manually in place.

Once fixture sections 110 and 120 are positioned adjacent to each other—with screw ramp joiner 130 extending into the inner walls of fixture section 110, and outer bracket 150 extending into and along lipped channels 125 and 126 of fixture section 120—joiner screw 154 may be driven through hole 155 in outer bracket 150, bore 118 of first fixture section 110, and against screw ramp 134 of joiner bracket 130. As joiner screw 154 is driven against the angled walls of screw ramp 134, screw ramp joiner 130 is "pulled" in toward first fixture section 110 (in the negative x-direction). Accordingly, the extent to which joiner screw 154 is driven downwardly can control the relative longitudinal positioning of fixture sections 110 and 120. In this manner, an operator or technician may engage joiner screw 154, observe the movement of fixture sections 110 and 120, and stop turning the joiner screw 154 once fixture sections 110 and 120 are sufficiently adjacent to each other and form—a joining operation that is performed by turning a relatively accessible and easy-to-reach fastener.

In some embodiments, an additional fastener, such as finishing screw 156, may be provided to further increase the strength of the joining system. As shown in FIG. 3, finishing screw 156 may be driven through hole 117 in fixture section 110, and into and through finishing boss 135 of screw ramp joiner 130. In some implementations, finishing boss 135 may move into alignment with hole 117 once fixture sections 110 and 120 are immediately adjacent to each other. Finishing screw 156 and finishing boss 135 may provide a more stable and consistent connection compared to the frictional engagement between joiner screw 154 and screw ramp 134.

Figure 5A:
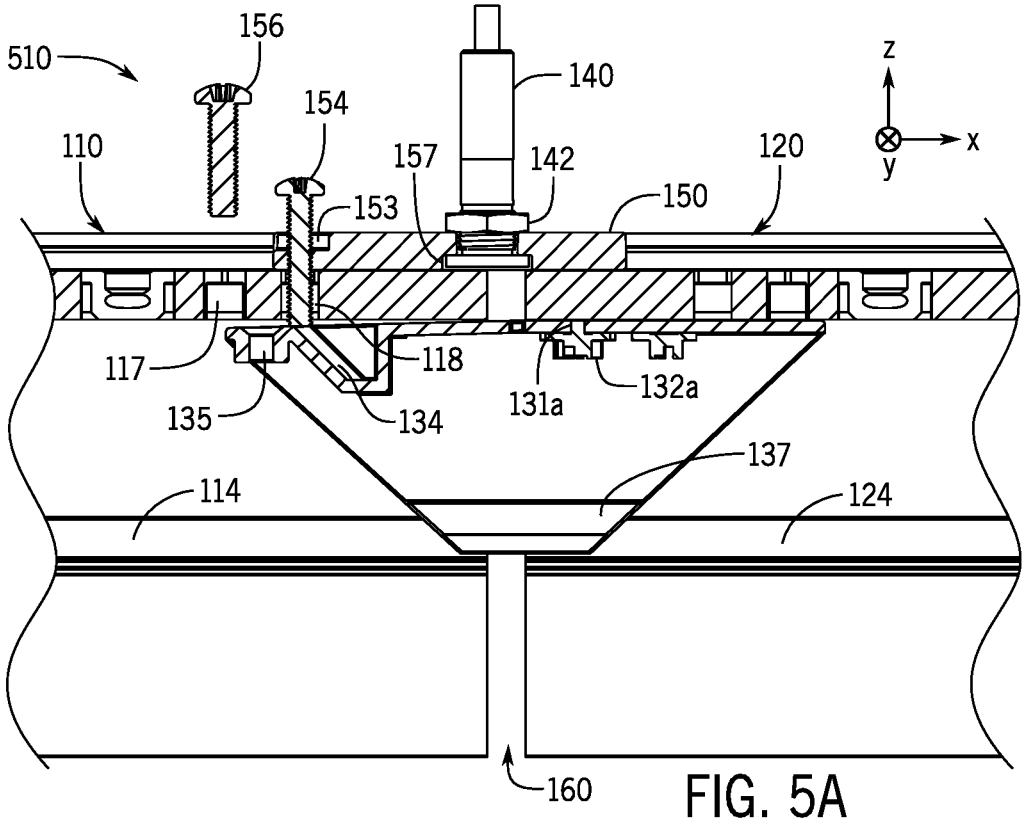
FIGS. 5A-5D are detailed, side elevated sectional views of the light fixture assembly, taken along lines 5-5 of FIG. 1, and looking in the direction of the arrows, illustrating an example tightening procedure for joining adjacent fixture sections of the light fixture assembly.

FIGS. 5A-5D illustrate the above-describe assembly process from a side elevated sectional view. FIG. 5A depicts fixture sections 110 and 120 being approximately adjacent to each other, but with gap 160 separating the adjacent fixture sections 110 and 120. As shown in FIG. 5A, screw ramp joiner 130 is positioned such that the left-most end (in the negative x-direction) of screw ramp 134 is positioned below bore 118 and joiner screw 154. In the state of partial assembly shown in FIG. 5A, hole 117 is not yet in alignment with finishing boss 135. Between FIGS. 5A and 5B, joiner screw 154 is driven downwardly and against the sloped wall of screw ramp 134, pulling screw ramp joiner 130 and fixture section 120 toward fixture section 110, decreasing the width of gap 160.

Figure 5B:
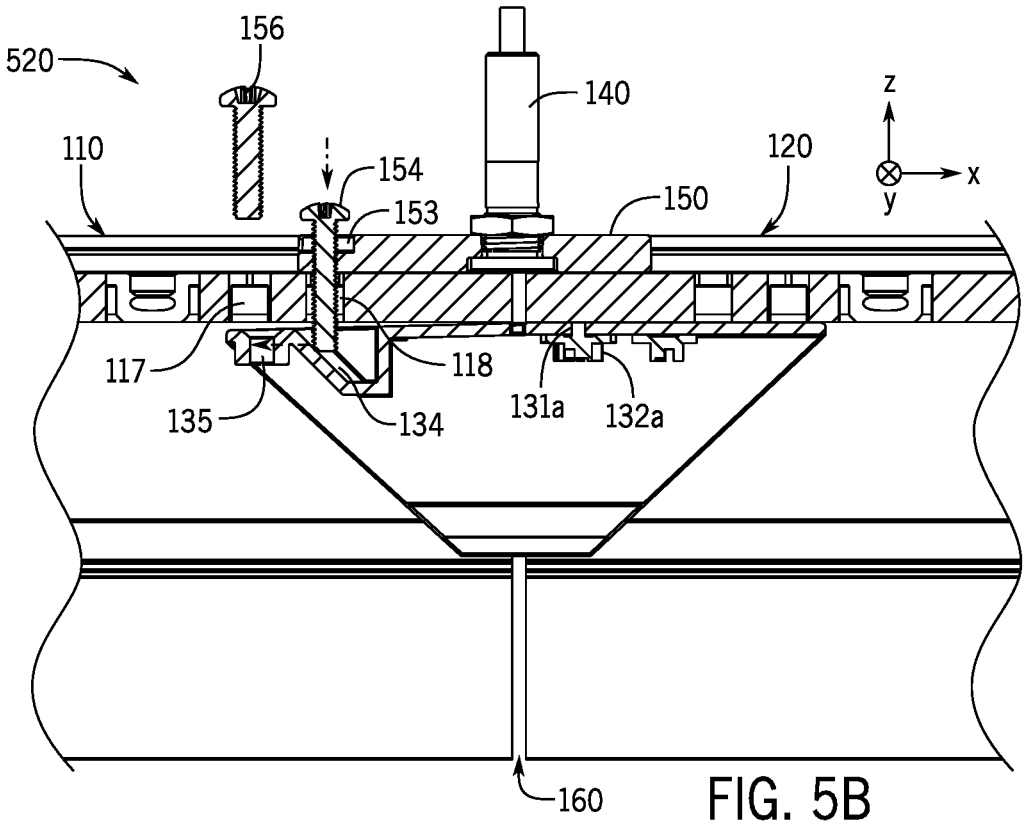

As shown in FIG. 5B, the downward movement of joiner screw 154 produces a downward force against screw ramp 134 of screw ramp joiner 130, which in turn is translated into a longitudinal force, as illustrated by the dashed arrows in FIG. 5B. With screw ramp joiner 130 being rigidly coupled to fixture section 120, the pulling force on screw ramp joiner 130 causes fixture sections 110 and 120 to move toward each other, bringing hole 117 and finishing boss 135 closer to alignment in the process. Between FIGS. 5B and 5C, joiner screw 154 is further driven downwardly and against the sloped wall of screw ramp 134, further pulling together fixture sections 110 and 120 until they abut.

Figure 5C:
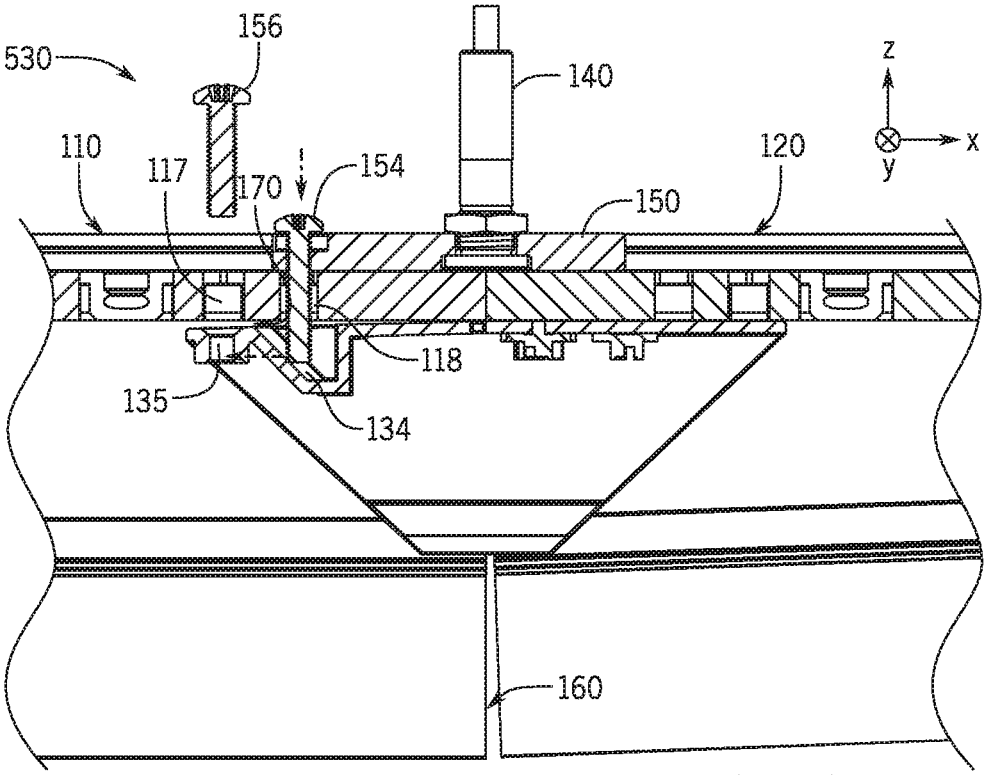
Figure 5D:
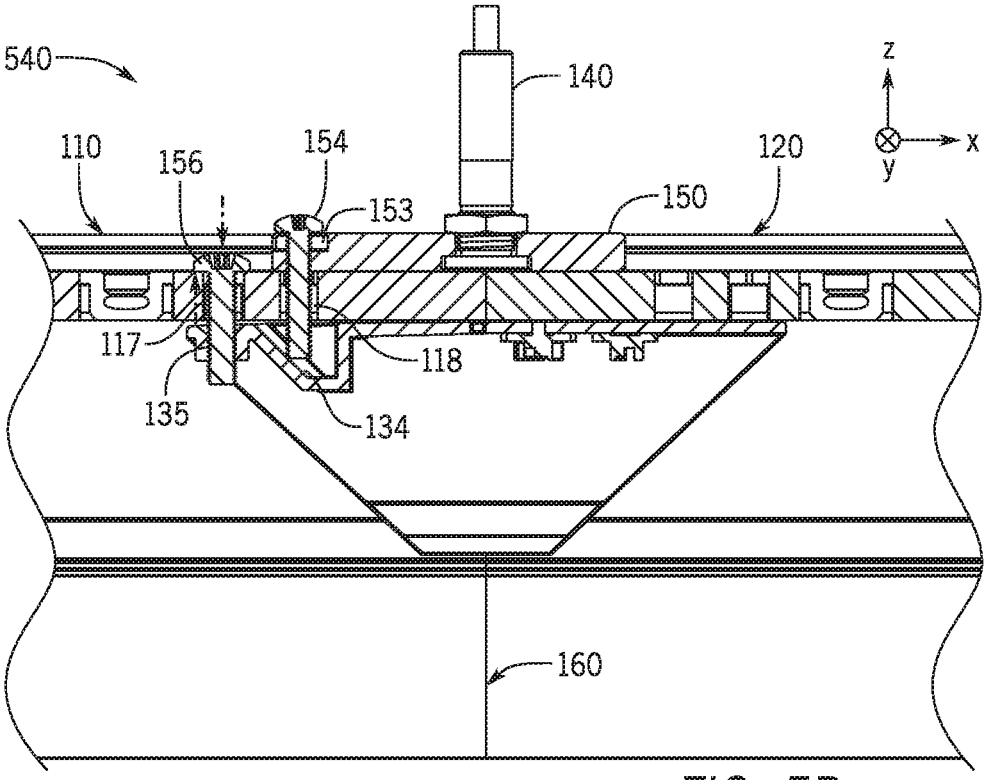

With fixture sections 110 and 120 immediately adjacent to each other, as illustrated in FIG. 5C, hole 117 and finishing boss 135 move into vertical alignment. This vertical alignment in turn enables finishing screw 156 to be driven through both hole 117 of fixture section 110 and finishing boss 135 of screw ramp joiner 130, as shown in FIG. 5D. As shown in FIG. 5C, at least the top ends of fixture sections 110 and 120 are brought together, such that they are immediately adjacent and/or abut one another near the top of light fixture assembly 100. However, due in part because screw ramp joiner 130 is positioned proximate to the top of fixture sections 110 and 120, gap 160 may remain between the bottom ends of fixture sections 110 and 120. To address this problem, joiner brackets according to the present disclosure may include a top section having two portions, with one portion being angled or sloped at a slightly declined angle relative to the other portion.

Figure 7:
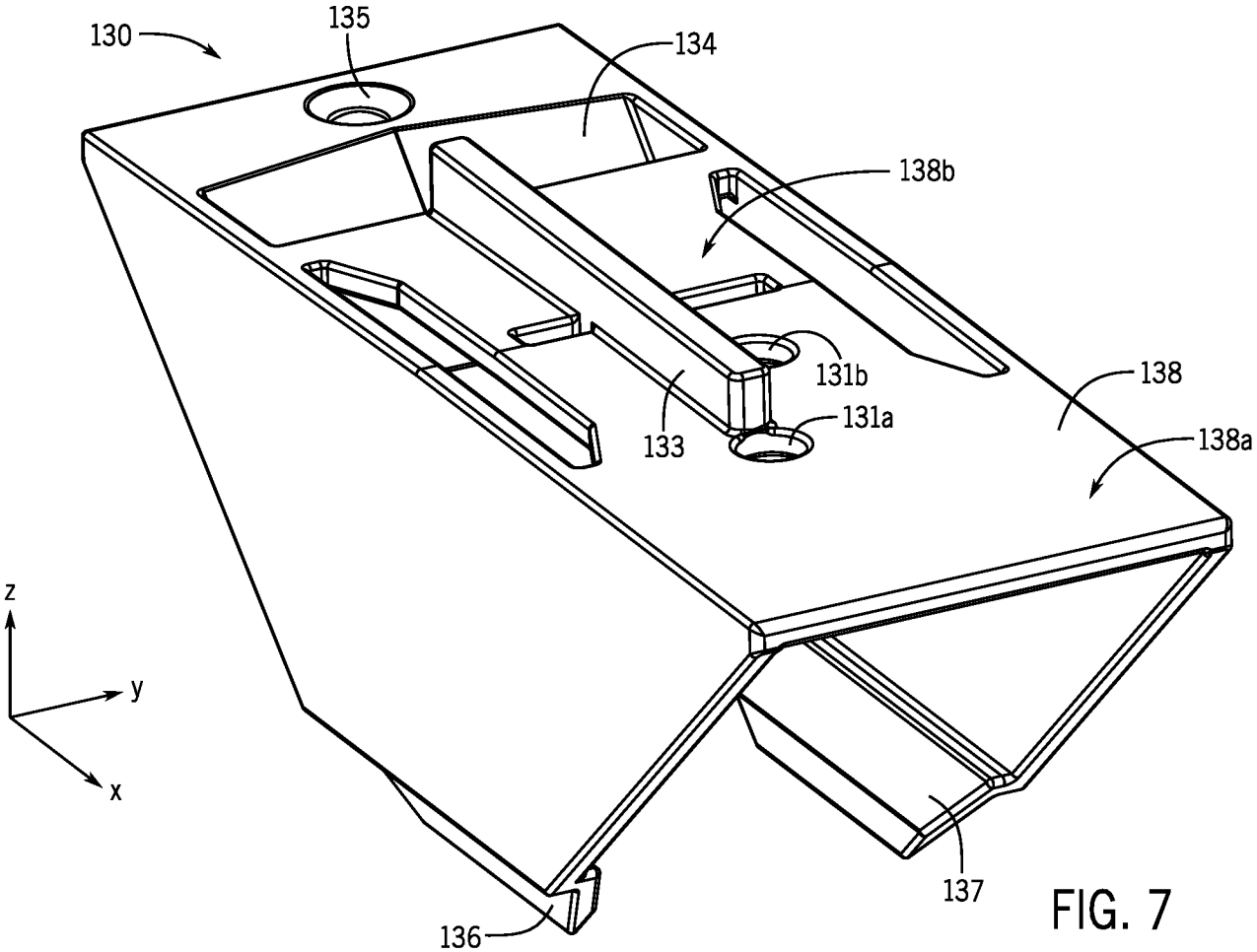
FIG. 7 is a perspective view of the screw ramp joiner, according to the embodiment of FIG. 3.
Figure 8:
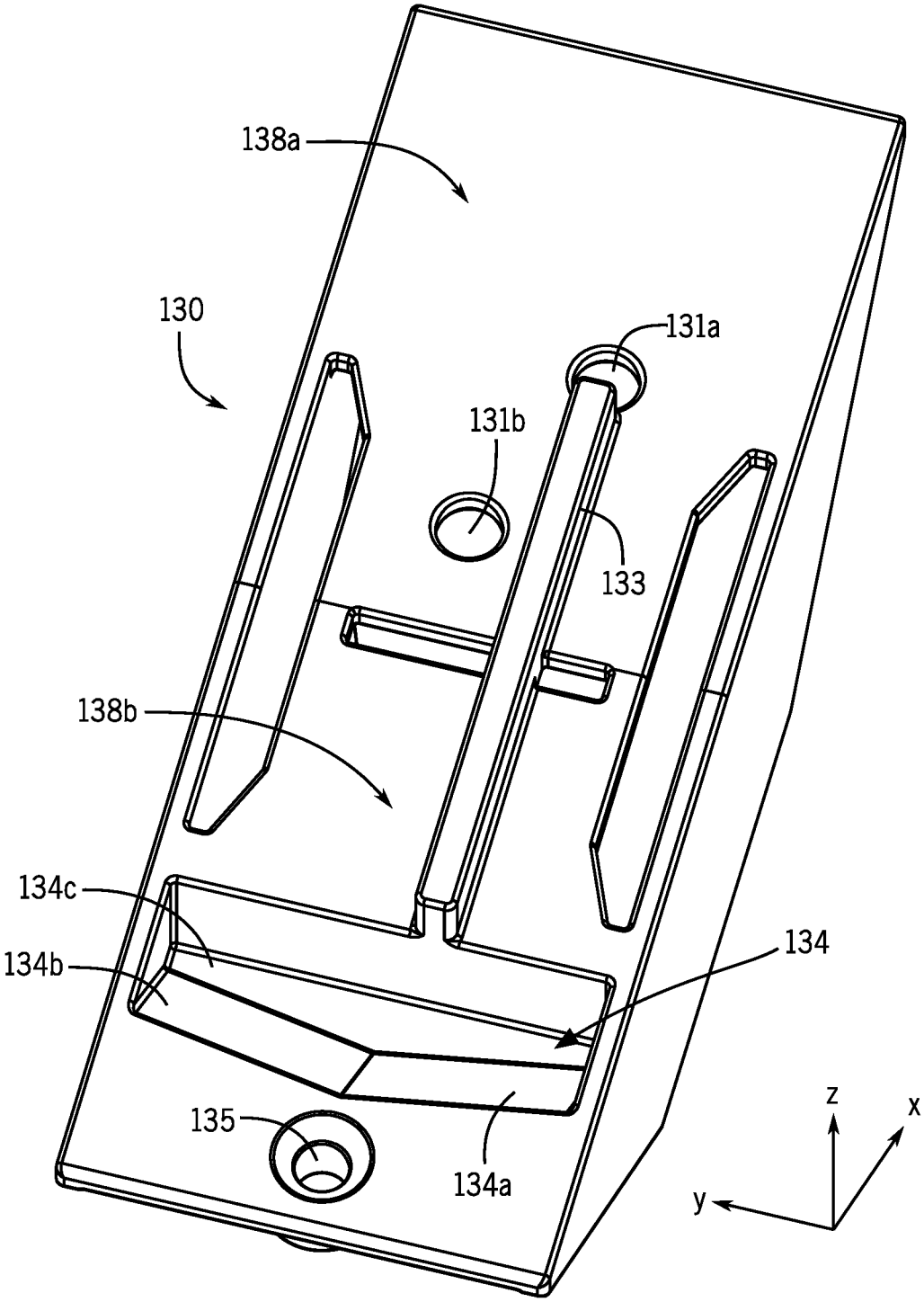
FIG. 8 is another perspective view of the screw ramp joiner, according to the embodiment of FIG. 3.
Figure 9:
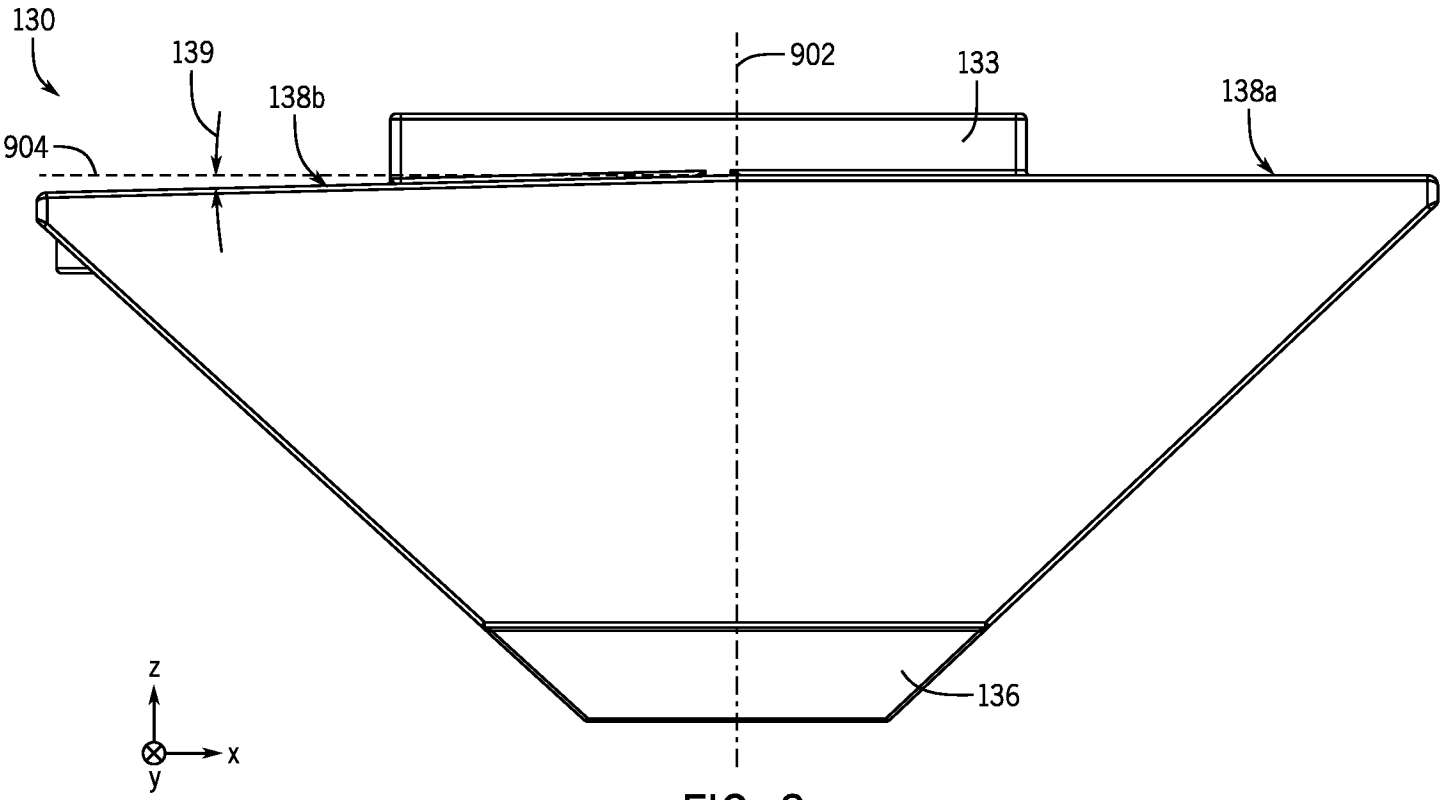
FIG. 9 is an elevated side view of the screw ramp joiner, according to the embodiment of FIG. 3, illustrating an asymmetry in the shape of the screw ramp joiner.

In an example implementation—such as the implementation shown in FIGS. 5A-5D, and also depicted in FIGS. 7 through 9—the portion of screw ramp joiner 130 that extends into fixture section 110 may slope downwardly (e.g., from 1 to 3 degrees, among other possible angles) relative to the portion of screw ramp joiner 130 that extends into fixture section 120. The downward sloped portion of screw ramp joiner 130 may leave a small space 170 between the top surface of screw ramp joiner and the inner walls of fixture section 110. As shown in FIGS. 5C and 5D, finishing screw 156 is driven through hole 117 and finishing boss 135. As finishing screw 156 is tightened, it exerts an upward force on the portion of screw ramp joiner 130 extending into fixture section 110. With the opposing end of screw ramp joiner 130 being rigidly coupled to fixture section 120, the upward force applied proximate to the left end (the negative x-direction) produces a torque that prompts screw ramp joiner 130 to rotate about the y-axis. This rotational force, in turn, causes the bottom end of fixture section 120 to pulled toward the bottom end of fixture section 110 as finishing screw 156 is driven through finishing boss 135 of screw ramp 130.

While the asymmetric, partially-sloped top section of screw ramp joiner 130 may beneficially enable the joiner to exert additional forces or torques to facilitate the joining of fixture sections 110 and 120, the slight angle may also enable the joiner system to tolerate slight vertical misalignment during the installation process—to increase the likelihood that the joining system functions properly within a range of manufacturing tolerances. Once joiner screw 154 and finishing screw 156 are sufficiently driven into place, as is illustrated in FIG. 5D, gap 160 is decreased to the point where fixture sections 110 and 120 are sufficiently proximate to each other. As described above and clearly shown in FIGS. 5A-5D, the joining operation can be performed by tightening fasteners that are accessible on the outside of light fixture system 100, resulting in a faster, less complicated, and safer installation procedure, as compared to traditional joining systems.

Figure 6A:
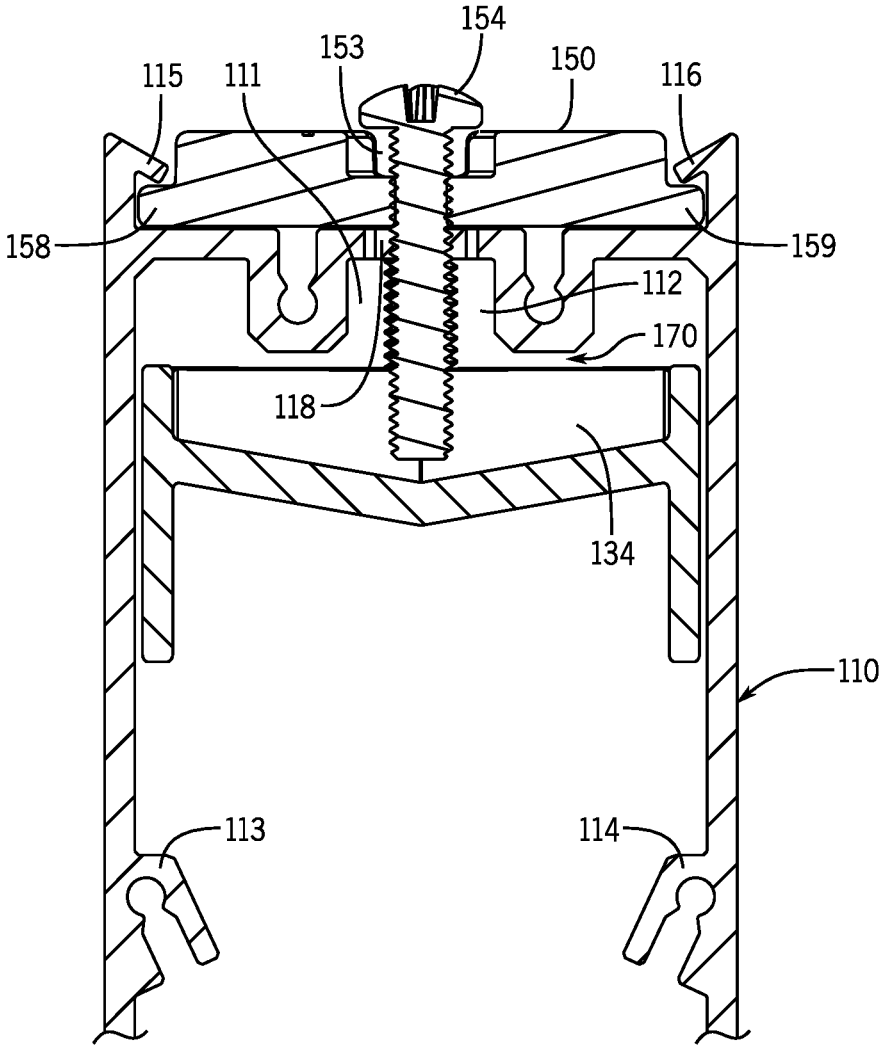
FIG. 6A is a front elevated sectional view of the light fixture assembly, taken along lines 6A-6A of FIG. 1, and looking in the direction of the arrows.
Figure 6A:
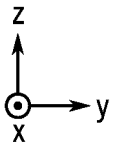
Figure 6B:
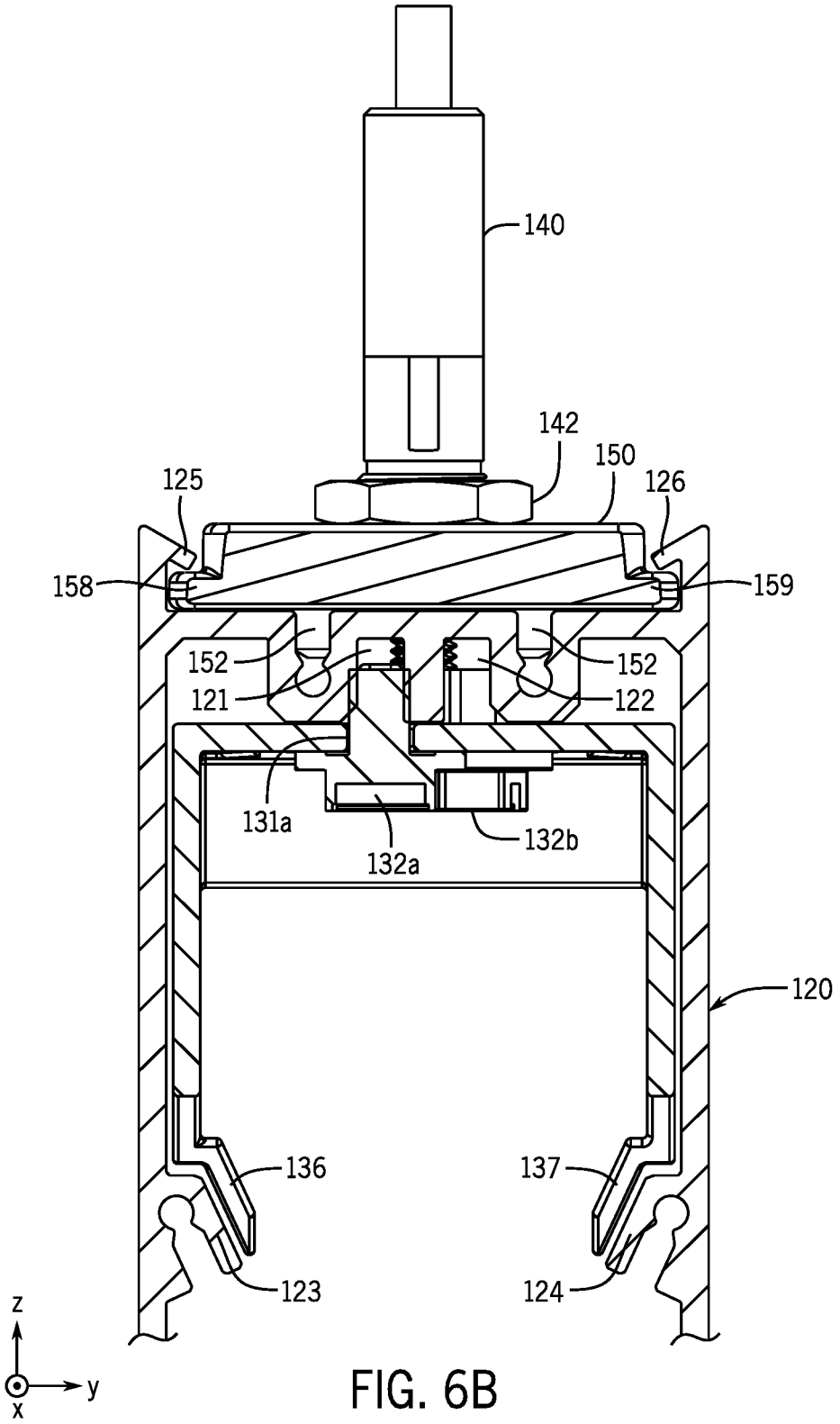
FIG. 6B is a front elevated sectional view of the light fixture assembly, taken along lines 6B-6B of FIG. 1, and looking in the direction of the arrows.

FIGS. 6A and 6B depict front elevated sectional views of light fixture assembly 100, taken along lines 6A-6A and 6B-6B as shown in FIG. 1. In particular, the cross-sectional plane of FIG. 6A is a y-z plane that extends through joiner screw 154, while the cross-sectional plane of FIG. 6B is a y-z plane that extends through fastener 132*a*.

As shown in FIG. 6A, there exists gap 170 between screw ramp joiner 130 and fixture section 110, as a result of the slight declined angle of the portion of screw ramp joiner 130 that extends into fixture section 110. In some instances, gap 170 may enable finishing screw 156 to apply an upward (positive z-directional) force on screw ramp joiner 130, to further improve the strength and robustness of the joint between fixture sections 110 and 120.

As shown in FIG. 6B, fasteners 132*a* and 132*b* extend upwardly through holes 131*a* and 131*b*, and into rails 121 and 122, respectively, of fixture section 120. In this manner, screw ramp joiner 130 may be rigidly coupled to fixture section 120 prior to the installation and assembly process of light fixture 100. In some cases, screw ramp joiner 130 may be rigidly coupled to fixture section 120 by a manufacturer prior to installation, which may reduce the number of on-site assembly steps involved in installing light fixture 100.

FIGS. 7-9 illustrate different views of screw ramp joiner 300. As shown in FIGS. 7 and 8, the holes, bosses, and/or fastener apertures may be formed as countersink holes to provide for some degree of misalignment (in the x-direction and/or in the y-direction) of fasteners being extended therethrough during installation of light fixture assembly 100. Slots, cutouts, or other spaces may be formed in screw ramp joiner bracket 130 for various manufacturing, tolerance, and/or flexibility reasons.

In some implementations, such as the embodiment shown in FIGS. 7 and 8, screw ramp 134 may include two or more angled walls 134*a* and 134*b*—each of which having a slightly different x-y slope—which meet and form an oblique or obtuse "V" shape. Such a combination of differently angled walls may increase the area of contact between joiner screw 154 with screw ramp 134 to reduce bearing stresses, and/or further facilitate alignment of screw ramp joiner 130 with fixture section 110 during a joining operation. As used herein, the term "oblique corner" may generally refer to two or more surfaces or walls that are not co-planar, and meet at any angle (preferably, an obtuse angle). In some embodiments, screw ramp 134 may include a bottom surface or trough 134*c*, which may be at approximately the same angle as portion 138*a* or portion 138*b* of the top section of screw ramp joiner 130.

FIG. 9 depicts screw ramp joiner 130 from a side elevated perspective, illustrating the top section of screw ramp joiner 130 including a sloped portion 138*b*. On the right side of divider 902, portion 138*a* of the top section of screw ramp joiner 130 may be parallel to tenon 133 and the lower end of offset 136. However, on the left side of divider 902, portion 138*b* of the top section of screw ramp joiner 130 may decline at angle 139 relative to portion 138*a*. As described above, angle 139 may enable the joiner system to accommodate for slight vertical misalignment during the installation process, and to increase the likelihood that the joining system functions properly within a sufficient range of manufacturing tolerances.

Although FIGS. 1-9 and their accompanying detailed description show and describe a particular implementation—with extruded aluminum fixture sections having specifically placed rails and channels, a screw ramp joiner system with a particular set of dimensions, angles, number of fasteners, and particular types of fasteners, and other specific details—it will be appreciated by one of ordinary skill that the principles behind the design and construction of a joiner system based on screw ramp joiner 300 may be applied to produce similar alternative designs. For example: the angle or angles of the walls of screw ramp 134 may be varied, the types of fasteners used to secure screw ramp joiner 130 to fixture sections 110 and/or 120 may be any suitable type of fastener, or may be replaced with alternative structures for rigidly coupling components together; joiner screw 154 may be any suitable fastener that can be driven downward in a controlled manner; and the types of fasteners themselves can be substituted, and/or a variety of other elements may be altered from that shown and described herein, without departing from the scope of the present disclosure. Other "screw ramp" joiner or bracket designs may be used, which apply the same invention as shown, described, and contemplated herein. It should be understood that the present disclosure is not limited to the particular embodiment shown in FIGS. 1-9, and encompasses other designs based on the design techniques and operating principles of joining systems disclosed in the present application.

Although certain example methods and apparatus have been described herein, the scope of coverage of this patent is not limited thereto. On the contrary, this patent covers all methods, apparatuses, and articles of manufacture fairly falling within the scope of the appended claims, either literally or under the doctrine of equivalents.

It should be understood that arrangements described herein are for purposes of example only. As such, those skilled in the art will appreciate that other arrangements and other elements (e.g. machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location, or as other structural elements described as independent structures may be combined.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. It is also to be understood that the terminology used herein is for the purpose of describing particular implementations only, and is not intended to be limiting.

What is claimed is:

1. A lighting fixture system comprising:

a first fixture section having a proximal end and a distal end opposite the proximal end, a first sidewall and a second sidewall each extending between the proximal and distal ends of the first fixture section, and a top portion extending between the first and second sidewalls of the first fixture section, the top portion of the first fixture section having a boss extending therethrough, and wherein the proximal and distal ends of the first fixture section define a longitudinal direction;

a second fixture section having a proximal end and a distal end opposite the proximal end, a first sidewall and a second sidewall each extending between the proximal and distal ends of the second fixture section, and a top portion extending between the first and second sidewalls of the second fixture section, the proximal end of the second fixture section being adapted for positioning adjacent to the distal end of the first fixture section;

a joiner bracket adapted for positioning beneath, and for engagement with, respective undersides of both the top portion of the first fixture section and the top portion of the second fixture section, said joiner bracket being capable of being rigidly coupled to the second fixture section such that a portion of the joiner bracket extends beyond the proximal end of the second fixture section toward the distal end of the first fixture section, in which the portion of the joiner bracket extending beyond the proximal end of the second fixture section has an angled wall that is angled downwardly toward the second fixture section;

an outer bracket configured for positioning above, and for engagement with, respective top sides of both the top portion of said first fixture section and the top portion of said second fixture section; and a fastener configured to extend through the outer bracket and through the boss in the top portion of the first fixture section, and to directly engage the angled wall of said joiner bracket, to produce a force in the longitudinal direction toward the proximal end of the first fixture section, wherein, when the joiner bracket is rigidly coupled to the second fixture section, engaging the fastener directly with the angled wall of said joiner bracket both aligns and pulls the proximal end of the second fixture section toward the distal end of the first fixture section.

2. The lighting fixture system according to claim 1, wherein the boss of the first fixture section is a threaded boss, and wherein the fastener is a threaded fastener.

3. The lighting fixture system according to claim 1, wherein the fastener is a first fastener, and a portion of the joiner bracket positioned beneath the second fixture section includes one or more bores, and wherein the lighting fixture system further comprises one or more second fasteners configured to extend through the second fixture section and into the one or more respective bores to rigidly couple the joiner bracket to the second fixture section.

4. The lighting fixture system according to claim 1, in which said first fixture section further includes a first rail positioned along the first sidewall of the first fixture section, and said second fixture section further includes a first rail positioned along the first sidewall of the second fixture section, and wherein the joiner bracket further includes a first sidewall and a second sidewall, said first sidewall of the joiner bracket having formed therein an offset having a shape that is complementary to the first rail of the first fixture section and the first rail of the second fixture section.

5. The lighting fixture system according to claim 1, wherein the fastener is a first fastener, wherein the joiner bracket further comprises a finishing aperture, in which said first fixture section further comprises a finishing bore, and wherein the lighting fixture system further includes a finishing fastener adapted to extend through the finishing bore and said finishing aperture of the joiner bracket.

6. The lighting fixture system according to claim 1, wherein the first fixture section further comprises at least one lipped channel extending longitudinally along the top portion of said first fixture section, in which said outer bracket is adapted to slideably engage with the at least one lipped channel of the first fixture section.

7. The lighting fixture system according to claim 1, wherein the lighting fixture system further comprises a cable gripper coupled to said outer bracket, the cable gripper being adapted to maintain a suspension cable therethrough for suspending the light fixture system from a ceiling.

8. The lighting fixture system according to claim 1, in which said first fixture section further includes a first rail positioned along the top portion of said first fixture section, and wherein the joiner bracket further includes an elongated male projection adapted to slideably engage with the first rail of said first fixture section, to facilitate alignment of the joiner bracket with respect to said first fixture section.

9. The lighting fixture system according to claim 1, wherein the angled wall of the joiner bracket comprises a first angled wall and a second angled wall that converge to form an oblique corner.

10. The lighting fixture system according to claim 1, in which the portion of said joiner bracket positioned beneath the proximal end of the second fixture section has a first top surface, the portion of said joiner bracket extending beyond the proximal end of the second fixture section has a second top surface, and wherein the first top surface is angled relative to the second top surface.

11. The lighting fixture system according to claim 10, wherein the fastener is a first fastener, wherein the joiner bracket further comprises a finishing aperture positioned within the first top surface, in which said first fixture section further comprises a finishing bore, and wherein the lighting fixture system further includes a finishing fastener adapted to extend through the finishing bore and said finishing aperture of the joiner bracket, wherein engaging the finishing fastener with said finishing aperture produces a torque that further pulls the second fixture section toward the first fixture section.

12. A joiner system comprising:

a joiner bracket adapted for positioning beneath, and for engagement with, respective undersides of both a top portion of a first fixture section and a top portion of a second fixture section, said joiner bracket being capable of being rigidly coupled to the second fixture section such that a portion of the joiner bracket extends beyond a proximal end of the second fixture section toward a distal end of the first fixture section, in which the portion of the joiner bracket extending beyond the proximal end of the second fixture section has an angled wall that is angled downwardly toward the second fixture section;

an outer bracket configured for positioning above, and for engagement with, respective top sides of both the top portion of said first fixture section and the top portion of said second fixture section; and a fastener configured to extend through the outer bracket and through an aperture in the top portion of the first fixture section, and to directly engage the angled wall of said joiner bracket, to produce a force toward the proximal end of the first fixture section, wherein, when the joiner bracket is rigidly coupled to the second fixture section, the fastener directly engages the angled wall of said joiner bracket to align and pull the proximal end of the second fixture section toward and into juxtaposition with the distal end of the first fixture section.

13. The joiner system according to claim 12, wherein the fastener is a threaded fastener.

14. The joiner system according to claim 12, wherein the joiner bracket further includes a first sidewall and a second sidewall, in which said first sidewall of the joiner bracket has formed therein an offset having a shape that is substantially complementary to at least a rail of the first fixture section.

15. The joiner system according to claim 12, wherein the fastener is a first fastener, wherein the joiner bracket further comprises a finishing aperture, wherein the joiner system further includes a finishing fastener adapted to extend through finishing aperture of the joiner bracket, to couple the joiner bracket to the first fixture section.

16. The joiner system according to claim 12, wherein the joiner bracket further includes an elongated male projection adapted to slideably engage with a rail of said first fixture section, to facilitate alignment of the joiner bracket with respect to at least said first fixture section.

17. The joiner system according to claim 12, wherein the angled wall of the joiner bracket includes a first angled wall and a second angled wall, which first and second angled walls converge to form an oblique corner.

18. The joiner system according to claim 12, in which the portion of said joiner bracket has a first top surface positioned beneath the proximal end of the second fixture section, the portion of said joiner bracket extending beyond the proximal end of the second fixture section having a second top surface, and wherein the first top surface is angled relative to the second top surface.

* * * * *